United States Patent [19]

Tappert et al.

[11] Patent Number: 4,566,385

[45] Date of Patent: Jan. 28, 1986

[54] HYDRAULIC DRIVE FOR MULTI-COLOR SHEET-FED ROTARY PRINTING MACHINES

[75] Inventors: Hans-Jürgen Tappert; Johannes Naumann, both of Coswig; Karl-Heinz Förster, Dresden; Herbert Doliner, Niederau; Fritz Pieper; Werner Frenzel, both of Radebeul; Klaus Schanze, Coswig, all of German Democratic Rep.

[73] Assignee: Veb Kombinat Polygraph "Werner Lamberz" Leipzig, Leipzig, German Democratic Rep.

[21] Appl. No.: 614,727

[22] Filed: May 25, 1984

Related U.S. Application Data

[63] Continuation-in-part of Ser. No. 384,767, Jun. 3, 1982, abandoned, which is a continuation-in-part of Ser. No. 353,588, Mar. 1, 1982, abandoned.

[51] Int. Cl.[4] ..... B41F 5/02; B41F 13/00

[52] U.S. Cl. ..... 101/183; 101/216

[58] Field of Search ..... 101/180, 181, 182, 183, 101/216, 219, 184; 60/423, 393, 394

[56] References Cited

FOREIGN PATENT DOCUMENTS

| | | | |
|---|---|---|---|
| 90799 | 6/1972 | German Democratic Rep. | 101/183 |
| 737245 | 5/1980 | U.S.S.R. | 101/183 |

*Primary Examiner*—J. Reed Fisher

*Attorney, Agent, or Firm*—Michael J. Striker

[57] ABSTRACT

A hydraulic drive for a multi-color, sheet-fed rotary printing machine assembled of a plurality of consecutively arranged press units each having a set of sheet-processing cylinders and gear trains interconnecting the cylinders, is constituted by the following combination:

a plurality of constant-flow, radial piston type hydraulic motors directly connected for driving a cylinder in each press unit;

a first hydraulic control means including a main directional control valve and an auxiliary or switching directional control valve connected between the source of pressure fluid and the hydraulic motors; and a second hydraulic control means including a control cylinder-and-piston unit assigned to each operational radial piston of the motors and controlled by the latter so as to overlap in the cross-over position of the motors both the intake port and the discharge port for working fluid.

3 Claims, 5 Drawing Figures

PRIOR ART

HYDRAULIC DRIVE FOR MULTI-COLOR SHEET-FED ROTARY PRINTING MACHINES

CROSS-REFERENCE TO RELATED APPLICATIONS

This application is a continuation-in-part of copending application Ser. No. 384,767 filed June 3, 1982, now abandoned, which in turn is a continuation-in-part of application Ser. No. 353,588, filed on Mar. 1, 1982, now abandoned.

BACKGROUND OF THE INVENTION

The present invention relates in general to multicolor, sheet-fed rotary printing machines consisting of a plurality of consecutively arranged press units each having a plurality of sheet-processing cylinders and gear trains for interconnecting the press units. In particular, this invention relates to a hydrualic driving device for use with such a printing machine.

From prior art, a driving device for printing machines of the above type is known, for example from the DD patent 90 799, in which the individual press units of the printing machine are interconnected by gear trains and driven by hydraulic motors. In order to differentiate the torque of the hydraulic motors, a control unit is provided including pressure-reducing valves or flow control valves for varying the working conditions of the machine.

The disadvantage of such known drives employing hydraulic motors in connection with preset valves is a relatively costly installation and operation. Moreover, such known drives are not suitable for all kinds of operational modes required for multi-color printing machines. Particularly, they are unsuitable for speed adjustment in the range from 1 to 100 for reducing the speed to a slow run with 1.5 rotations per minute to the full rotary speed required for the machine. Also, the prior-art drives do not meet the requirement of a uniformly high torque at a constant rotary speed necessary for ensuring a good quality of the print.

Still another disadvantage of such conventional hydraulic drives for printing machines is their incapability of achieving a jerk-free start during an intermittent or stepwise mode of operation.

SUMMARY OF THE INVENTION

It is therefore a general object of the present invention to overcome the aforementioned disadvantages.

More particularly, it is an object of the invention to provide an improved hydraulic drive for multi-color printing machines of the above described type which contributes to a high quality of printing.

An additional object of the invention is to provide such an improved drive which, by means of built-in damping means, ensures a minimum generation of vibrations.

A further object of the invention is to provide such an improved device which is capable of adjusting the printing machine into a large variety of operational conditions without excessive technological and operational phase.

In keeping with these objects, and others which will become apparent hereafter, one feature of the invention resides in the provision of a plurality of constant-flow, radial piston type hydraulic motors each having an intake port and a discharge port for working fluid, and means for distributing the fluid from the ports to respective radial pistons, a power output member directly connected to a cylinder in an assigned press unit for driving the latter, an adjustable pump for supplying working fluid into the hydraulic motors, an electric motor for driving the pump, a first hydraulic control means including a main control valve and a switching control valve connected between the pump and the hydraulic motors, and a second hydraulic control means cooperating with the intake and discharge ports of respective radial pistons to positively overlap both ports for a short period of time when the corresponding radial piston reverses its operational phase.

In this manner, it is achieved that the hydraulic drive for multi-color, sheet-fed rotary printing machines has a constant high torque at each press unit, a broad range of adjustment of rotary speed, is capable of achieving extremely low and continuous rotary speeds, and at the same time the technological and installation costs are reduced.

The positive overlap of the second hydraulic control means over the intake and discharge ports is at least 0.3 mm.

In the intake pressure conduit to the switching directional control valve in the first hydraulic control means there is provided a throttle for damping the starting shock, and in the return pressure conduit of the switching valve is connected a flow-regulating valve which ensures a constant rotary speed during the lowermost mode of operation of the machine independently from variations of the torque allied to the machine.

The flow cross section of the throttle and of the flow-regulating valve are matched to each other; the flow cross section of the throttle, however, is larger than the flow cross section of the flow-regulating valve.

The novel features which are considered characteristic for the invention are set forth in particular in the appended claims. The invention itself, however, both as to its construction and its method of operation, together with additional object and advantages thereof, will be best understood from the following description of specific embodiments when read in connection with the accompanying drawing.

DESCRIPTION OF THE PREFERRED EMBODIMENT

Figure 1:
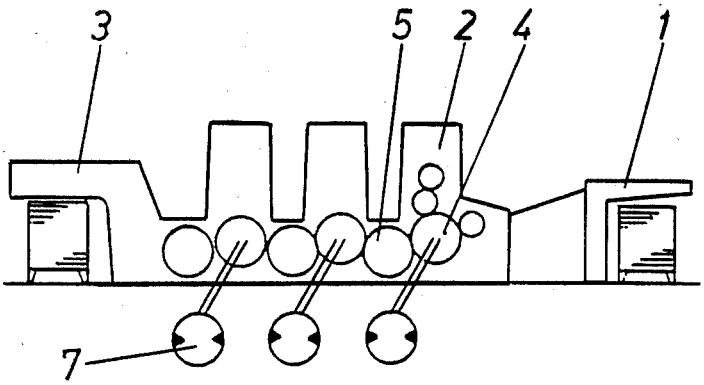
FIG. 1 is a schematic side view of a multi-color, sheet-fed rotary printing machine.

Referring firstly to FIG. 1, it will be seen that a multi-color, sheet-fed rotary printing machine consists of a sheet-feeding apparatus 1 and, consecutively arranged one after the other, a plurality of press units 2, and a printed sheet discharge device 3. Each press unit 2 includes a set of cylinders, in this example an impression cylinder 4 and a transfer cylinder 5 for advancing the sheets to be printed. As seen from FIG. 2, the sheet-guiding cylinders 4 and 5 are interconnected by means of a gear train 6. One of the sheet-guiding cylinders in each press unit 2 is directly connected, without any transmission gears, to the power output member of a constant flow, radial piston type hydraulic motor 7. All hydraulic motors are connected in parallel to an intake pressure fluid conduit 12 and to a return pressure conduit 13. The torques of respective constant flow hydraulic motors are adjusted to power requirements of the assigned press units 2, and the possible requirements for excess torques for ensuring the abutment of teeth in the gear train 6. The synchronization of individual press units 2, that is, the achievement of a reliable engagement of tooth flanks in the gear train 6, which is necessary for a good printing quality, is realized by adjusting the torque of the hydraulic motors in respective press units. This adjustment is independent from the number of cylinders in each unit; it is immaterial whether the press unit is equipped with three cylinders or with five cylinders.

A first hydraulic control device 8 is common to all parallel-connected hydraulic motors 7 and will be explained in greater detail below. A hydraulic pump 9 driven by an electric motor 10 supplies pressure fluid into the intake high-pressure conduit 12. The output of pump 9 is adjustable while the electric motor 10 is of constant speed. In this manner, the different working speeds of the printing machine are set by adjustment of the hydraulic pump 9.

The hydraulic control unit 8 includes a main directional control valve 21 for switching on the machine in its forward run and to stop the machine; an auxiliary switching directional control valve 22 serves for adjusting the low run of the machine, for the forward, rearward and stepwise modes of operation, and for the stop.

Figure 2:
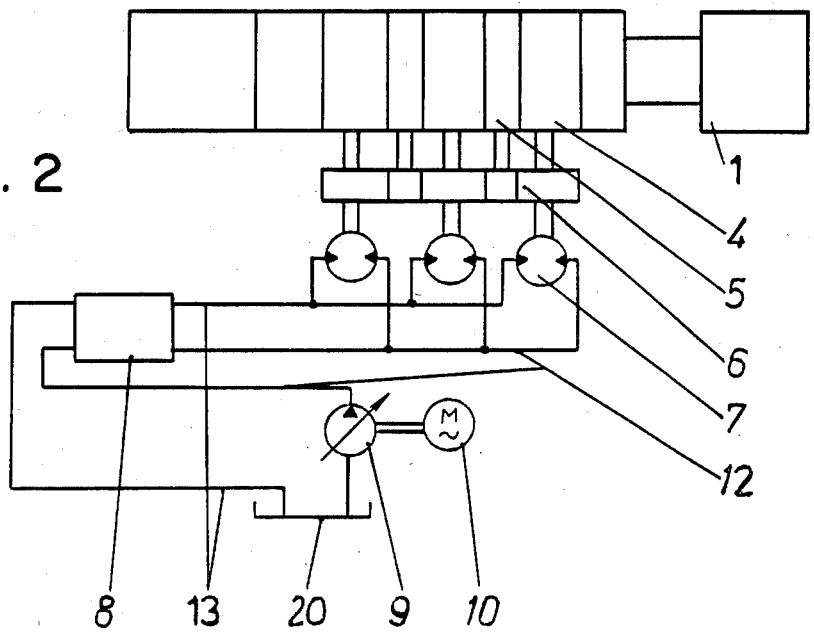
FIG. 2 is a schematic plan view of the machine of FIG. 1 with schematically indicated hydraulic driving device.
Figure 4:
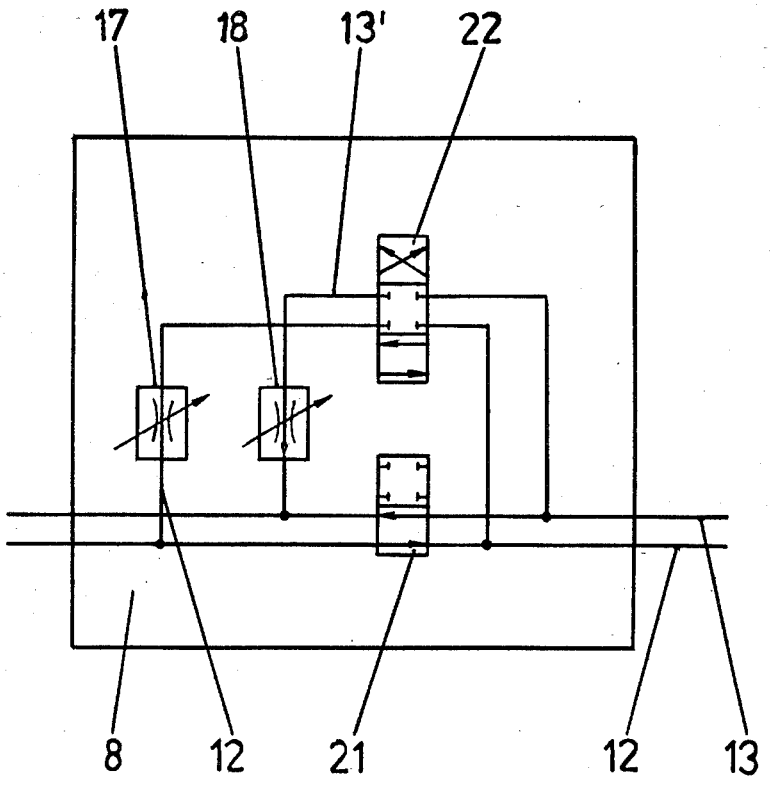
FIG. 4 is a circuit diagram of a first hydraulic control means in the driving device of FIG. 2, including the main-and the switching directional control valves.

Referring now to FIG. 4, high-pressure branch conduit 12 connects an adjustable throttle 17 to one port of the switching control valve 22, and an adjustable flow-regulating valve 18 is connected between the return pressure conduit 13 and the other port of the switching valve 22. The throttle 17 serves for damping the starting shocks, and the pressure-regulating valve 18 serves for achieving a constant speed independently from the torque variations of the printing machine. The return conduit 13 and the inlet of the pump 9 are connected to a tank 20 for the working fluid (FIG. 2).

Figure 3B:
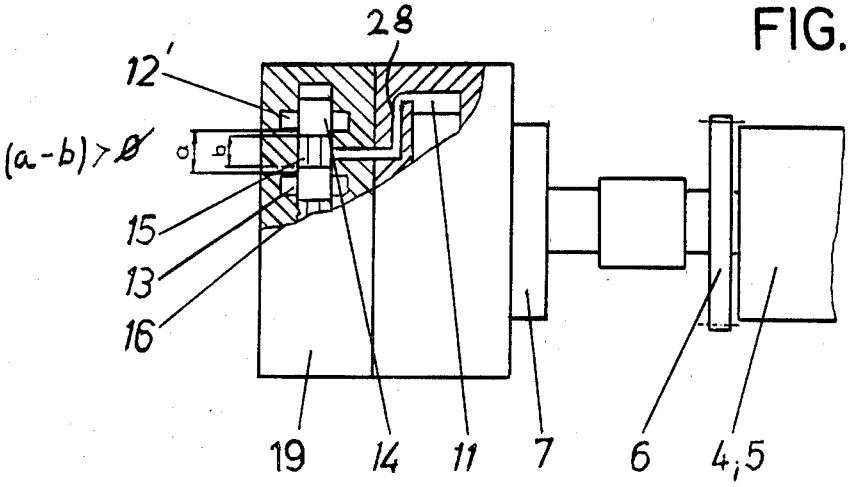
FIG. 3B is a side view, partly in section, of a radial piston type hydraulic motor similar to that of FIG. 3A with means for controlling the overlap of intake and discharge ports in cross-over position of a control piston.
Figure 3A:
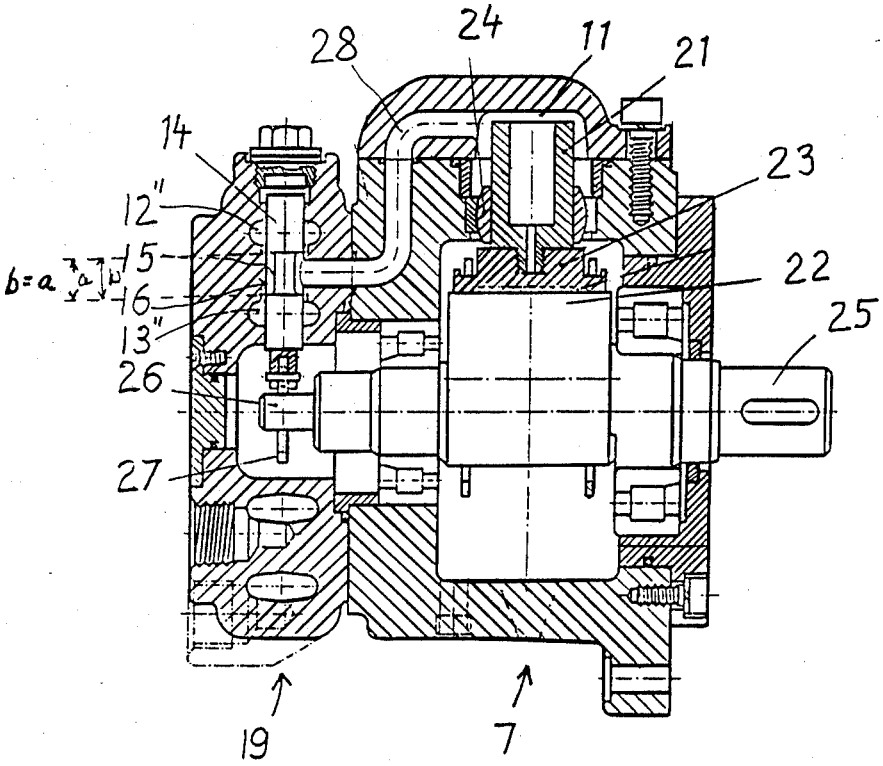
FIG. 3A is a sectional side view of a prior art radial piston-type hydraulic motor.

A conventional low speed hydraulic motor 7 in connection with hydraulic control means 19 is illustrated in FIG. 3A. The motor 7 includes operating radial pistons 21 slidably engaging via slippers 23 main eccentric portion 22 of shaft 25. The radial pistons 21 move in a piston chamber 11 and are guided by spherial guiding members 24. Means 19 for controlling the operation of motor 7 include radial control pistons 14 slidably held by a ring 27 against another eccentric portion 26 of the driving shaft 25. The control pistons 14 (of which only one is shown in the Figure) move in corresponding cylinders 16 communicating via passages 28 with the piston chamber 11 of the hydraulic motor 7. Each control piston 14 is formed with an annular groove 15. Passage 28 opens into the piston cylinder 16 in the range of the annular groove 15. Intake conduit 12 and a discharge or return conduits 13 communicate with cylinder 16 through ports 12'' and 13'' situated at opposite sides of the passage 28. Due to the fact than in a cross-over position (as shown in FIG. 3A) the control edges of the groove 15 are in alignment with control edges of ports 12'' and 13'', the prior art hydraulic motor is unsuitable for achieving extremely low rotary speeds and jerk-free starts required for the crawling operation of the printing machine, namely for a rotary speed of about 1.5 rotations of the guiding cylinders per minute. For this reason, according to another feature of this invention, each radial control piston 14 of the hydraulic control means 19, when moved into its crossover position relative to the posts of conduits 12 and 13, positively overlaps the two ports 12' and 13' of conduits 12 and 13. It is also possible to use other kinds of overlap control devices such as a rotary slider. The term "positive overlap" in this context denotes a control of a radial piston type hydraulic motor in which during the crossing of the control piston over the intake and return ports, the intake stream of high-pressure fluid from the pump is momentarily interrupted, that is, during the reversing phase of the control piston there is to communication between the piston chamber 11 of the motor 7 and the return conduit 13 or the intake conduit 12. (FIG. 3B).

For this purpose, the control piston 14 of the second hydraulic control means 19 is designed in such a manner that the axial clearance b of its annular groove, 15 is smaller than the spacing a between, the control edges of the port 12' of the high-pressure conduit 12 and the port 13' of the return conduit 13 opening into the cylindrical bore 16 for the control piston 14. For achieving the aforementioned extremely low rotary speeds of the machine during the crawling operation, the positive overlap (a - b) is at least 0.3 mm.

This arrangement, in combination with the aforedescribed features of the hydraulic drive, makes it for the first time possible a practical use of hydraulic motors in a multicolor printing machine without excessive technological costs while all desired modes of operation of the machine and a good printing quality are maintained.

The operation of the hydraulic drive of this invention is as follows:

Upon activation of the electric motor 10 the pump 9 starts delivering a stream of pressure oil from tank 20. As mentioned before, the built-in adjuster in the pump permits a continuous regulation of the supplied stream of pressure fluid. In the principal mode of operation of the machine, the working fluid is supplied through intake conduit 12, the main directional control valve 21 of the first hydraulic control unit 8 to the constant-flow hydraulic motors 7. Each of the motors 7 drives directly a sheet-guiding cylinder (4 or 5) of a press unit 2 of the machine. The return conduit 13 guides the return flow of fluid from the hydraulic motors to the tank 20.

By differentiating the torques of individual hydraulic motors 7, each press unit 2 is driven at such a power only which is necessary for the operation of the unit 2 and which ensures a continuous engagement of teeth flanks in the gear train 6. As a consequence, no synchronization of the rotary speeds of the motors 7 is necessary.

The second hydraulic control means 19 for controlling the intake and discharge for each piston of the hydraulic motor 7 includes a control cylinder 16 for guiding control pistons 14 driven in a known manner by the shaft of the radial piston motor. These second control means 19 perform the pressure fluid distributing function and ensure that each of the piston chambers 11 in the hydraulicmotor 7 is supplied during its working phase with the intake high-pressure fluid from the conduit 12 and thereupon is brought into communication with return conduit 13 (non-working phase).

During the reversal of the working phase into non-working phase, and vice versa, the control piston 14 crosses over the intake and discharge ports 12' and 13' and piston chamber 11 is simultaneously disconnected both from the intake port and from the discharge port (the positive overlap). By virtue of the positive overlap with a certain minimum value set by tolerances of the control piston 14 and its piston cylinder 16, it is achieved that the range of rotary speed of the hydraulic motor can be shifted downwards to extremely low values, so that the hydraulic motor for the first time can be employed for the so-called "crawling" or extremely slow drive of the printing machine.

By throttle 17 arranged in the intake branch conduit 12' to the switching directional control valve 22, the stream of pressure fluid when the main control valve 22 is closed, is adjusted by the adjustable restriction of the throughflow cross section in such a manner that the throughflow varies proportionally to the pressure difference across the throttle 17.

If the constant-flow hydraulic motors 7 are switched on from their inactive condition into motion, then the transient pressure difference across the throttle 17 produces a differentiated stream of working fluid which is adjusted by the throttle 17 to a value at which the motors 7 are accelerated continuously and without any jerks. In this manner, it is achieved that, when the machine is switched over to the stepwise mode of operation, no jerking starts due to the sudden application of the pressure fluid stream, will occur. As soon as the flow-regulating valve 18 connected in the return branch conduit 13' from the switching control valve 22 passes return fluid from the motors 7, it starts regulating the rotary speed of the motors to the required constant value (about 1.5 rotations per minute). At the same time, the throttle 17 is ineffective.

The effective cross section of the throttle 17 is adjusted to the flow volume passing through the flow-regulating valve 18 so that it is effective only at the instant of starting when the pressure fluid has not yet flowed through the flow-regulating valve 18. In other words, the throttle has a larger flow cross section than the flow-regulating valve 18. The valve 18 connected in the return conduit 13 through the auxiliary switching valve 22 thus becomes effective in the extremely slow mode of operation of the driving device and keeps the adjusted stream from conduit 13 constant independently from the variations of the torque of the machine, and consequently a constant rotary speed of the motors 7 for the slow continuous mode of operation is achieved. In other operational modes, the throttle 17 and the flow-regulating valve 18 are without effect.

Since the flow-regulating valve 18 starts functioning with running motor only, i.e. when return flow of working fluid is available, a relatively large starting jerk would result in the printing machine when the flow regulation is initiated.

The throttle 17, however, adjusts the intake flow to the motors to a value at which this starting jerk is avoided. Due to different frictional conditions, at the start of the machine a higher pressure difference is produced across the throttle during the starting period than during a continuous operation.

For this reason, it will be understood that each of the elements described above, or two or more together, may also find a useful application in other types of constructions differing from the types described above.

While the invention has been illustrated and described as embodied in a hydraulic drive for use with multicolor, sheet-fed rotary printing machines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a multi-color, sheet-fed rotary printing machine including a plurality of consecutively arranged press units each having a plurality of sheet-processing cylinders, and gear trains for interconnecting said cylinders, a hydraulic driving device comprising a plurality of constant-flow radial piston type hydraulic motors each having an intake port and a discharge port for admitting and discharging pressure fluid and means for distributing the pressure fluid to respective radial pistons, a power output member directly connected to one of said cylinders in the assigned press unit for driving the same; an adjustable pump for supplying pressure fluid into said hydraulic motors; an electric motor for driving said pump; a first hydraulic control means including a main control valve and a switching control valve connected between said pump and said hydraulic motors; and second hydraulic control means provided in each of said hydraulic motors, said second hydraulic control means including a cylindrical bore, said ports communicating with said bore and forming with its inner wall control edges spaced apart in axial direction, a conduit opening into said bore between said control edges and leading to said distributing means, a reciprocating piston movable in said bore past said ports, said piston being formed on its jacket with an annular control groove which during the movement of said piston alternately connects one of said ports with said conduit, the axial clearance of said groove being shorter than axial spacing between said control edges so that during the reversal of working phase into discharging phase of respective radial pistons, said reciprocating piston positively overlaps for a short period of time the control edges of both ports.

2. A hydraulic driving device as defined in claim 1, comprising an intake conduit and a return conduit for connecting said pump to said hydraulic motors, said first hydraulic control means further including a flow-regulating valve connected in said return conduit via said switching control valve for adjusting a constant rotary speed of the motors during their extremely slow mode of operation independently from the torque variations of the machine; and a throttle connected in said intake conduit via said switching control valve, said throttle having larger flow cross section than that of the flow regulating valve to damp the starting jerks of the motors.

3. A hydraulic driving device as defined in claim 1 wherein the difference between said axial clearance of said groove and the axial spacing of said control edges is at least 0.3 mm.

* * * * *